US006076996A

United States Patent [19]

Choate et al.

[11] Patent Number: 6,076,996

[45] Date of Patent: Jun. 20, 2000

[54] OFFSHORE JACKUP HULL-TO-LEGS LOAD TRANSFER DEVICE AND ELEVATING AND LEG GUIDE ARRANGEMENT

[75] Inventors: Kenneth P. Choate, Houston; John S. Laird, II, Cypress, both of Tex.

[73] Assignee: Zentech, Inc., Houston, Tex.

[21] Appl. No.: 09/275,613

[22] Filed: Mar. 24, 1999

Related U.S. Application Data

[63] Continuation of application No. 08/924,859, Aug. 30, 1997, Pat. No. 5,906,457.

[51] Int. Cl.[7] ..... F02B 17/08

[52] U.S. Cl. ..... 405/198; 254/112

[58] Field of Search ..... 405/198, 197, 405/196, 199, 203, 224; 254/112, 95

[56] References Cited

U.S. PATENT DOCUMENTS

| | | | |
|---|---|---|---|
| 85,598 | 1/1869 | Lewis | 405/198 |
| 5,906,457 | 5/1999 | Choate et al. | 405/198 |

*Primary Examiner*—Eileen Dunn Lillis
*Assistant Examiner*—Frederick Lagman
*Attorney, Agent, or Firm*—Robert C. Shaddox; Winstead Sechrest & Minick P.C.

[57] ABSTRACT

An arrangement of a jackup platform's elevating system, leg guides, hull-to-legs load transfer device, and method of operation of the load transfer device for an offshore jackup platform's hull to be supported by legs which have one or more vertical toothed gear racks attached. An apparatus consisting of rectangular blocks with protruding lugs that are shaped for efficient engagement with a portion of the upper faces of the gear rack teeth, that extend vertically on the leg chords of the jackup platform. The rectangular blocks are movable in a direction perpendicular to one side of the gear rack. Powered guide assemblies control movement of the rectangular blocks such that their protruding lugs can move into the spaces in between the gear rack teeth. The protruding lugs of the rectangular blocks can then bear against the gear rack teeth and faces of the rectangular blocks can bear against structure of the hull to transfer hull weight and storm induced interaction forces between the hull and the legs of the jackup platform.

19 Claims, 14 Drawing Sheets

OFFSHORE JACKUP HULL-TO-LEGS LOAD TRANSFER DEVICE AND ELEVATING AND LEG GUIDE ARRANGEMENT

BACKGROUND OF THE INVENTION

This is a continuation of the application, Ser. No. 08/924,859, filed on Aug. 30, 1997, now U.S. Pat. No. 5,906,457.

FIELD OF THE INVENTION

This invention relates to an arrangement of a jackup platform's leg chords, elevating system, and leg guides that work in conjunction with a hull-to-legs load transfer device, to support the weight of the hull and storm induced forces between the legs and the hull of the jackup platform. The elevating system arrangement has climbing pinion gear unit support housings that contain both gear units on one side of a trussed leg chord and rollers on the opposite side. The housings are connected to the hull of the jackup platform with pinned links that allow the housings to move laterally with respect to the hull. This ability to move laterally, allows the jack housings to be guided to the legs and to also move with the legs, as they move within the constraints of the leg guides, that are in the openings in the hull, through which the legs pass. The load transfer device is an apparatus that consists of rectangular load blocks, with protruding lugs, that interact with toothed gear racks on the jackup's legs, to transfer hull weight and storm induced forces from the hull to the legs.

Self-elevating type mobile offshore platforms, commonly referred to as "jackups" have been used for oil or gas well drilling, work platforms, oil or gas production platforms, and many other uses. These jackups usually consist of a barge shaped hull, supported by three or more trussed legs which usually extend vertically through openings in the hull. The trussed legs are usually fitted with vertically extending toothed gear racks on the chords of the legs and the hull is usually fitted with elevating gear units, commonly referred to as "jacks" that engage with the gear racks to raise and lower the legs when the jackup is afloat and to raise and lower the hull when the legs have penetrated the ocean floor.

For normal operations, when putting a jackup on an operating location, the legs are lowered to the ocean floor with the jacks and jacking continues until soil resistance to penetration of the legs causes the hull to lift out of the water a few feet. Additional soil resistance is usually developed to simulate the largest reaction between the legs and the ocean floor that may be anticipated while at that location. This is normally done by pumping sea water into ballast compartments of the hull. After developing this additional soil resistance, the hull is then elevated to the desired elevation, which is at least high enough to assure that the crest of the largest anticipated waves will be below the bottom of the hull.

While elevated in this operating position, jackups may be subjected to large loads from storm winds, waves and currents. These loads induce large interacting forces and moments between the hull and the legs of jackups.

The elevating gear units of a jackup, commonly referred to as "jacks" are usually mounted in housings that are located radially out from the center of each leg chord and extend vertically up from a location above the top deck of the hull. The gear units are normally mounted one above the other in the housings. Usually there are two levels of leg guides which keep the legs relatively perpendicular to the hull bottom. With this arrangement, the jacks resist all vertical interaction forces between the hull and the legs and the jacks work together with the leg guides to resist the storm induced moment between the hull and the legs.

One common arrangement of gear racks and jacks is to orient the gear racks and climbing pinions of the jacks radially out from the center of each leg. With this arrangement there is one gear rack per leg chord and one vertical row of jacks that interact with the single gear rack at each chord. When a climbing pinion of a jack interacts with a vertical gear rack the resultant force applied to the gear rack is relatively perpendicular to the contact face of the gear rack teeth. With this arrangement, the horizontal components of the forces applied to the gear racks, by the jack pinions, induce large forces into the leg braces, that are located nearest to a vertical position that is between the pinions and leg chords. These forces have a significant effect on the required size and strength of the bracing members. Since for different operating water depths, the jack pinions are aligned with different vertical positions on the legs, the required strength of most all the leg bracing is affected by the horizontal component of the forces applied to the gear racks by the jack pinions.

Another common arrangement of gear racks and jacks is to have opposed pairs of gear racks on each leg chord and opposed climbing pinions engaged with the opposed gear racks. With this arrangement the horizontal components of the pinions counteract each other through the leg chord instead of through the leg bracing. Although this arrangement prevents inducing the horizontal components of the pinion reactions into the leg braces between the leg chords, it does require two gear racks per leg chord. This double gear rack arrangement results in increased leg weight and leg construction cost.

When a jackup's hull is elevated above the water surface and the legs are subjected to storm loads, the magnitude of these loads is proportional to the projected area in the direction of the storm. The magnitude of these loads is also very sensitive to the shape of the individual members. Two gear racks on a leg chord has more projected area and a much worse shape factor for storm forces than a similar chord with only one gear rack. In general, this means that jackups, with opposed gear racks and jack pinions, have the disadvantage of having to resist higher magnitudes of storm forces when compared to jackups with similar shaped leg chords with only a single gear rack.

There are two basic types of jack housings that are commonly used on jackups. One type is where the jack housings is an integral part of the hull. Jackups with this type of jack housing is said to have "fixed jacks". Fixed jacks are relatively stiff, which causes a significantly large part of the interaction moments between the legs and the hull to be transferred through the jacks rather than through the leg guides. These storm induced moment reactions to the jacks, when combined with the gravity reactions to the jacks, may require the need for more jack units to adequately resist these reactions, than would be necessary for elevating the hull on the legs when making location moves. These additional jack units can significantly increase the cost of a jackup.

With fixed jacks the gear rack engagement pinions move laterally in all directions, with respect to the gear racks, as the legs move within the constraints of the leg guides. This may cause increased wear on the gear racks. To minimize this movement and wear, it is necessary to have very small clearances between the leg chords and the leg guides. In order to maintain small clearances, it is necessary to fabricate the legs very accurately to avoid looseness or binding in the leg guides. This requirement for high tolerance leg fabrication, increases the cost of leg construction, when compared with jackups that do not have fixed jacks.

The other type of jack housing that is commonly in use is one that reacts against the hull but is not physically connected to the hull. Jackups with jack housings of this type are said to have "floating jacks". For jackups with floating jacks, raising or lowering the legs, while afloat, will cause the bottoms of the jack housings to bear vertically against resilient pads which bear against the hull. For jackups with floating jacks, raising or lowering the hull, while the hull is supported above the water by the legs, will cause the tops of the jack housings to bear vertically against resilient pads which bear against ridged structural framework, that is attached to the hull. Jack housings of floating jacks, are guided to the leg chords and move with the legs as they move laterally within the constraints of the leg guides. As the jack housings move laterally, with respect to the hull, the resilient pads are flexible enough to laterally distort elastically.

For jackups with floating jacks, leg guide clearances do not need to be as small as for jackups with fixed jacks, because the lateral movement, of the legs, in the leg guides does not affect the meshing of the jack pinions and gear racks. With more clearance in the leg guides, the tolerances for leg fabrication can be relaxed. This can reduce leg fabrication costs, for jackups with floating jacks, when compared with jackups that have fixed jacks. The resilient pads are relatively soft which causes most of the interaction moment between the legs and the hull to be transferred through the leg guides rather than through the jacks. The result of this is less storm induced reactions to the jacks, which may result in a reduced number of jacks required to resist these reactions. This can significantly reduce the cost of a jackup, when compared with fixed jacks.

Since most of the interactive moments between the legs and the hull are taken by the leg guides, for jackups with floating jacks, the horizontal guide reactions between the leg chords and the leg guides are much higher that for jackups with fixed jacks. These upper and lower guide reactions create large axial forces in the leg braces that are located vertically between the upper and lower guides. Since for different operating water depths, different braces of the legs are located between the upper and lower guides, the required strength of most all leg braces are affected by these high guide reactions.

One disadvantage for jackups with floating jacks is the increased initial cost of the jackup due to the purchasing of the resilient pads. Another disadvantage is the cost of replacing these resilient pads while the jackup is in service. These resilient pads are usually made of natural rubber which deteriorates with age and the pads have to be replaced periodically.

When a jackup is elevated above the water, the independent legs may have differing amounts of penetration into the ocean floor. Because of this unequal penetration, and also because of unlevel ocean floors, it may not be possible to elevate the hull to a vertical position that will align the lower leg guides of the hull with brace-to-chord intersection nodes at each of the legs. When storm forces cause the leg guides to react laterally against the leg chords, at a location between the nodes, the reaction forces may cause excessive bending moments in the leg chords. The stresses, in the leg chords, that are caused by these bending moments, combines with the stresses due to the axial force in the leg chords. The highest axial stresses, in the leg chords, is normally located in way of the lower guides of the hull. This is also the location of high leg chord bending moments due to lower guide forces. The combination of axial stress in the leg chord, with the bending stresses caused by the lower guide forces, can require substantially higher strength for the leg chords than would be required if the lower guide forces were always located at a leg node. This combined stress requirement exists for jackups with either fixed jacks or floating jacks. It is more severe for jackups with floating jacks than for jackups with fixed jacks. This is because jackups with floating jacks, when compared with jackups that have fixed jacks, have a larger portion of the interaction moment between the legs and the hull taken by the leg guides, rather than by the jacks.

The various problems described above are represented in the art. Attempted solutions are presented in U.S. Patents: U.S. Pat. Nos. 3,343,371 Heitkamp; 4,269,543 Goldman et al.; 4,389,140 Bordes; 4,538,938 Grzelka et al.; 4,627,768 Thomas et al.; 5,092,712 Goldman et al.; 5,139,366 Choate et al.; 5,188,484 White; 5,486,069 Breeden; 5,611,645 Breeden; and 5,622,452 Goldman. Although the present invention provides solutions to problems not found or suggested in the listed patents, each of the cited references is hereby incorporated by reference for all disclosed therein.

As designers searched for solutions to the problems associated with the interactions of the legs and the hull of independent leg jackups, the development of a type of locking system that is now commonly known as "rack chocks" was developed. A rack chock consists of a section of gear rack, with the same tooth profile as the gear rack, on the leg chords, and various mechanisms to manipulate and secure the section of gear rack in a position where the matching profiles of the gear rack teeth of the leg chord and the gear rack teeth of the rack chocks are intermeshed. Once intermeshed and tightly secured, the weight of the hull and it's contents can be transferred from the jacks, of a jackup, to it's rack chocks. Then the upper, lower, and end faces, of the gear rack teeth and rack chock teeth, can interact to transfer combinations horizontal and vertical forces caused by the weight of the hull and the storm induced interacting forces between the legs and the hull.

The usual arrangement, for jackups with rack chocks, is for the rack chocks to be below the jacks and either above or just below the top deck of the hull. The upper leg guides are usually located above the jacks and the lower leg guides are usually located at the bottom of the hull. With a jackup's hull elevated above the water, and with it's rack chocks engaged, a storm can apply forces to the jackup that will cause the hull to deflect laterally and the legs to bend such that there will be differing amounts of relative lateral deflection between the hull and the portion of the legs that extend below the rack chocks. This relative deflection increases from zero at the rack chocks to a maximum at the bottom of the legs. When this happens, if the lower guides are some distance below the rack chocks and have small clearances to ensure that the legs are held in good alignment, for proper meshing of the gear teeth of the jacks with the gear racks on the leg chords, the lower guides will react against the legs preventing any relative deflection between the hull and the legs in the horizonal plane of the lower guides. These reactions, as previously explained, can induce increased axial forces in the braces of the leg and bending moments in the leg chords, adversely affecting their design. If the lower guides have very loose clearances to avoid these interaction forces at the lower guides, the legs cannot be held in good alignment with the hull and the jack pinions, when operating the jacks. The alignment, with this loose guide arrangement, will be dependent on the meshing of the jack pinions with the gear racks, and this is undesirable. Without close clearance lower guides, environmental forces that may exist while operating the jacks to make location moves, will induce interaction forces between the jack pinions and the gear racks that would normally be prevented by small clearance lower guides. Not only is leg to hull alignment affected, but there will likely be more rapid wearing of the gear racks by the jack pinions.

Rack chocks have been found to be very difficult to disengage. This is because of the multiple directions of interacting forces that the meshed gear rack and rack chock teeth can take. To disengage the rack chocks, it is necessary to operate the jacks to transfer the load from the rack chocks to the jacks. Because of the matching tooth profiles of the gear racks and the rack chocks, the load directions for the interaction forces between the gear racks and the rack chocks can reverse as the jacks transfer the weight of the hull and it's contents. When this happens, the jacks will be carrying more than the weight of the hull and it's contents and the rack chocks will be loaded, in reverse, with the difference between the load on the jacks and the weight of the hull and it's contents. To stop jacking at the precise moment when there is no load on the rack chocks, or when the load is small enough to allow the rack chocks to be retracted, is very difficult and time consuming. It could involve repeatedly reversing the jacks to remove the rack chocks, one leg chord at a time.

Gear racks and rack chocks are normally flame cut to the same profile. Because of this, there will be some misfit upon engagement of the rack chocks with the gear rack. This misfit can led to unequal load distributions between the individual gear rack and rack chock teeth. Depending on the degree of misfit, it may require local yielding at individual teeth before load sharing of all of the rack chock teeth can take place. Local yielding of rack chock teeth, caused by storm loads during engagement with gear rack teeth, that are out of tolerance, could be the cause of additional misfits when the rack chocks are engaged with the gear racks at other vertical locations on the legs.

SUMMARY OF THE INVENTION

It is the object of the present invention to provide an arrangement of a jackup's leg chords, jacking units, and leg guides, that function together with a unique hull-to-legs load transfer device that is quick and easy to operate and eliminates the disadvantages of the prior art.

It is an object of the present invention to provide, as a principal element of the invention, one or more rectangular blocks with one or more protruding lugs, which extend from one face, of the rectangular blocks, so as to engage with upper faces of the gear rack teeth, to transfer interacting forces between the gear racks, on the leg chords, and the hull.

It is another object of the present invention is to shape the protruding lugs, of the rectangular blocks, for contact with the desired surface area, on the upper faces of the gear racks, for applying the interacting loads between the legs and the hull. The desired surface area is one that is nearer to the roots, rather than the ends, of the gear rack teeth. The reason is to reduce the shear stresses in the gear rack teeth.

It is another object of the present invention to shape the protruding lugs of the rectangular blocks so that when the contact surfaces of the protruding lugs are in contact with the upper faces of the gear rack teeth, there are gaps between the upper faces of the protruding lugs and the lower faces of the gear rack teeth. These gaps allow for easy installation and removal of the rectangular blocks.

It is another object of the present invention to curve the contact area of the protruding lugs of the rectangular blocks, similar to the curved contact surface of the gear pinion teeth, in order to provide more elasticity in the contact area. This increased elasticity will aid in achieving load sharing of the individual gear rack teeth, which are interacting with the protruding lugs of the rectangular blocks.

It is another object of the present invention to manufacture the rectangular blocks from a material that is stronger and harder than the material used for manufacturing of the gear racks. This will insure that all local yielding, if yielding does in fact occur, will be limited to local yielding of the gear rack, not yielding of the protruding lugs of the rectangular blocks.

Still another object of the invention is to machine the contact surfaces of the rectangular blocks to an exacting tolerance, in order to minimize the degree of misfit upon contact with the teeth of the gear racks. With these more accurately manufactured, stronger, and harder rectangular blocks, local yielding will not only be minimal, but also isolated to a small area of the upper gear rack teeth surfaces that contact the curved surfaces, of the protruding lugs, of the rectangular blocks.

It is yet another object of the present invention to provide horizontal guide means, with power means, that cause the rectangular blocks to travel in directions that are normal to the flat sides of the gear racks, while maintaining the desired horizontal alignment positions, normal to the directions of travel.

An object of the present invention is to provide vertical guide means, attached to the horizontal guide means, that hold the rectangular blocks in horizontal positions relative to the horizontal guide means, while not providing support or resistance to vertical movement of the rectangular blocks.

An object of the present invention is to provide horizontal sliding surfaces that contact the bottom faces of the rectangular blocks and support the rectangular blocks in the desired vertical positions, on the hull, until the powered horizontal guide means slides the rectangular blocks into position with the protruding lugs, of the rectangular blocks, a short distance in between the gear rack teeth, at which point the rectangular blocks will slide off of these horizontal sliding surfaces and fall onto the gear rack teeth.

Another object of the present invention is to provide vertical surfaces that assist in guiding the rectangular blocks into, as well as out of, the engaged position with the gear rack teeth. These sliding surfaces will also serve to react against the rectangular blocks in order to transfer horizontal components of the interaction forces between the legs and the hull. The vertical surfaces will be parallel to the direction of travel, of the horizontal guide means. The faces of the rectangular blocks that are opposed to the protruding lugs, will always be in contact with the vertical surfaces.

An object of the present invention is to provide stop means, such that movement of the rectangular blocks by the power means, of the horizontal guide means, is stopped at locations where the centerlines of the rectangular blocks and gear racks are approximately collinear. Minor deviations from collinear may exist because the legs may be laterally located anywhere within the constraints of the leg guides.

An object of the present invention is for rectangular blocks, that are resting on the gear rack teeth of the legs, to be free to move vertically in the vertical guide means, while sliding against the stop means. This happens, to some rectangular blocks, while the jackup's elevating system is raising the hull on the legs, until all of the other rectangular blocks are in position, supported by the gear racks and in contact with the stop means.

An object of the present invention is to provide spacer means that are both vertically adjustable and load bearing. The spacer means are to have power means, to adjust the lengths of the spacer means, in order for them to fit tightly in the vertical spaces, between tops of the rectangular blocks and the bearing seats, on the hull. The tightly adjusted spacer means shall be capable of transferring the vertical interaction forces between the legs and the hull.

Another object of the present invention is to provide one gear rack per leg chord, arranged such that the vertical flat faces on the sides of the gear rack teeth will be normal to axes that extend radially out from the centerlines of the legs, so that rollers, mounted in the elevating gear unit housings, may be positioned with their perimeters tangent to the opposite sides of the leg chords from the gear racks. This will enable the rollers to counteract the horizontal components of the forces that the jack pinions apply to the gear racks.

An object of the present invention is to provide elevating gear unit support housings that support elevating gear units on one side of the leg chord and horizontal force counteracting rollers on the opposite sides of the leg chords.

Yet another object of the present invention is to provide links, with pins at each end, that connect the elevating gear unit support housings to the hull. These links will transfer vertical loads from the legs to the hull, allow torsional movement of the legs, about their vertical centerlines, within the constraints of the leg guides of the hull, and provide stiffness for vertical load transfer between the legs and the hull.

Still another object of the present invention is to utilize the lower leg guides as a part of the hull-to-legs load transfer device, such that they interact with the rectangular blocks, through the leg chords, minimizing the bending stresses in the leg chords that are caused by the horizontal interaction forces between the legs and the hull at the lower guides. Minimizing the introduction of bending stresses into the leg chords is achieved by vertically positioning the lower leg guides, that are on the opposite sides of the leg chords from the gear rack teeth, such that the forces applied to the gear rack teeth by the lugs, on the rectangular blocks, and the counteracting horizontal forces applied to the leg chords by the lower leg guides, can be resolved into vertical reactions collinear with the vertical axes of the leg chords, Yet another object of the present invention is to utilize the jacks to work in conjunction with the rectangular blocks to resist, storm induced, interaction moments between the legs and the hull. To do this, it will be necessary to transfer the loads on the jacks to the rectangular blocks by releasing the motor brakes. It will then be necessary to reset the motor brakes with the pinions rotated until they are in contact with the under side of the leg rack teeth. Some of the interaction moments, between the legs and the hull, may be of a magnitude to cause some of the rectangular blocks to take very large interaction forces, while other rectangular blocks may try separate from the hull at the bearing surfaces where the tops of the rectangular blocks contact the spacer means. When the rectangular blocks try to separate from their spacer means, interaction forces between the teeth of the gear pinions and the underside of the gear rack teeth will prevent this separation from happening.

DETAILED DESCRIPTION OF THE PREFERRED EMBODIMENT

Figure 1:
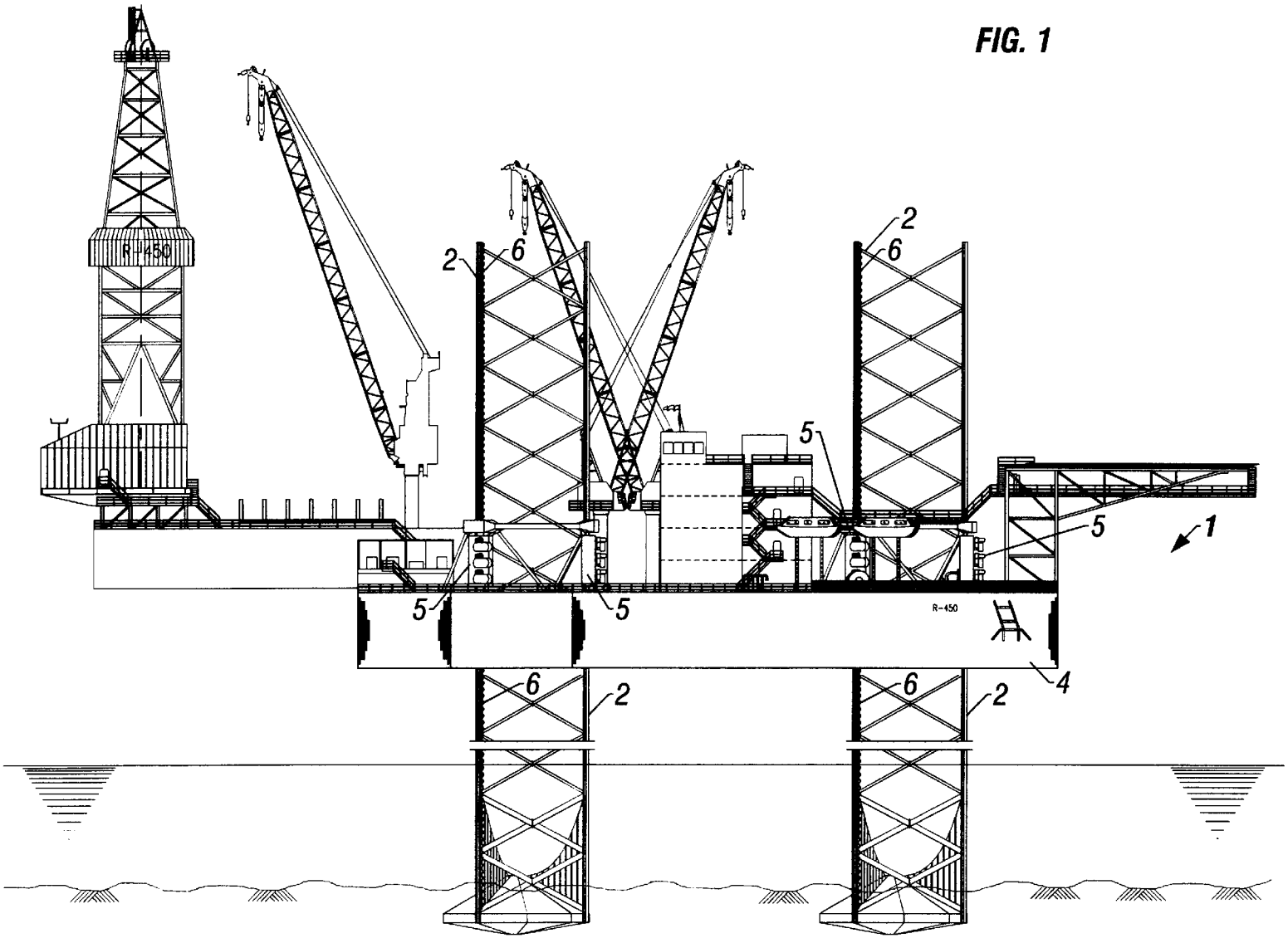
FIG. 1: is a schematic elevation view of one form of jackup with trussed legs.

For a further understanding of the nature and objects of the present invention, reference should be had to the following detailed description, taken in conjunction with the foregoing drawings, in which like parts are given like reference numerals.

Figure 2:
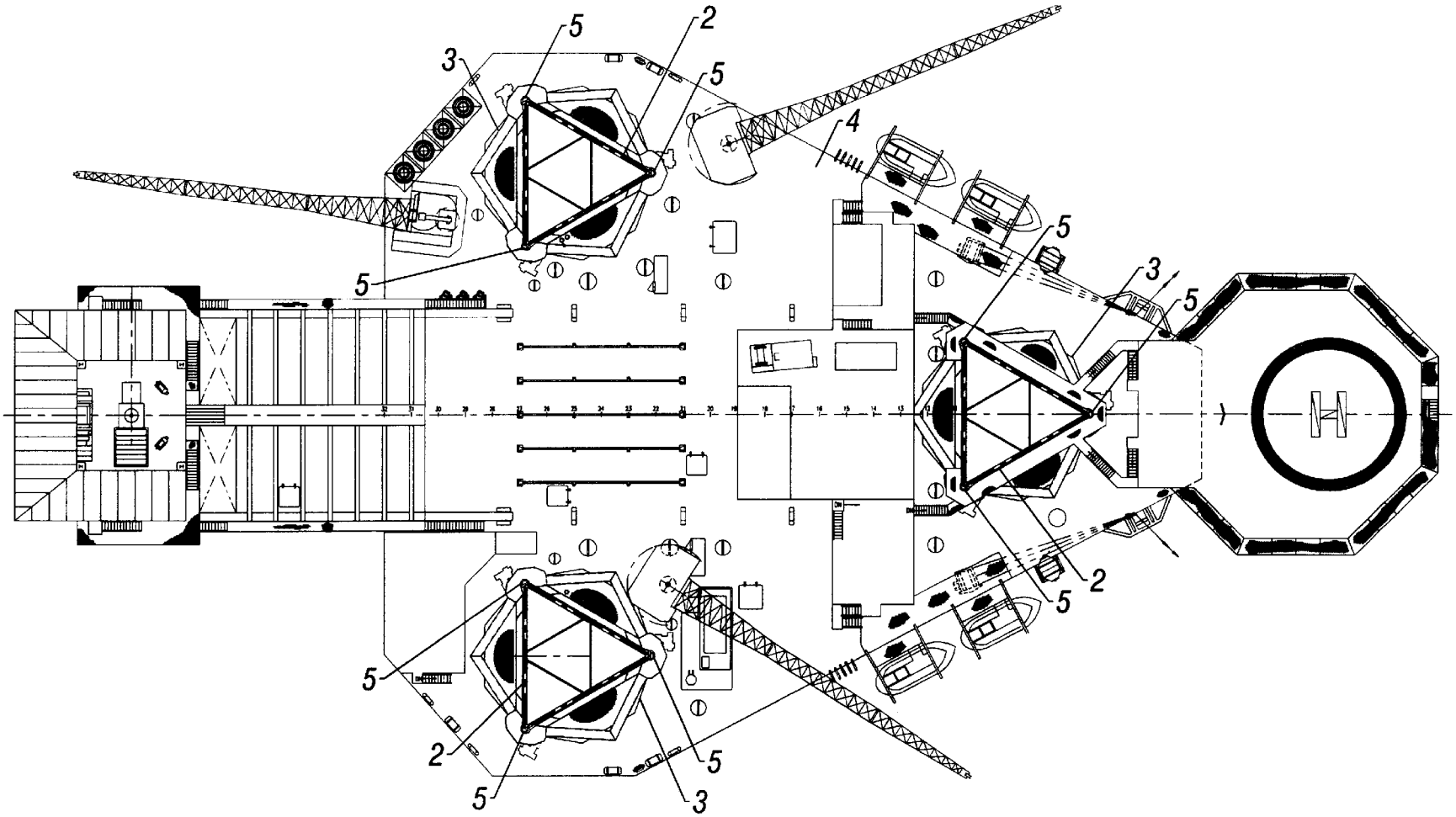
FIG. 2: is a schematic plan view of one form of jackup with trussed legs.
Figure 3:
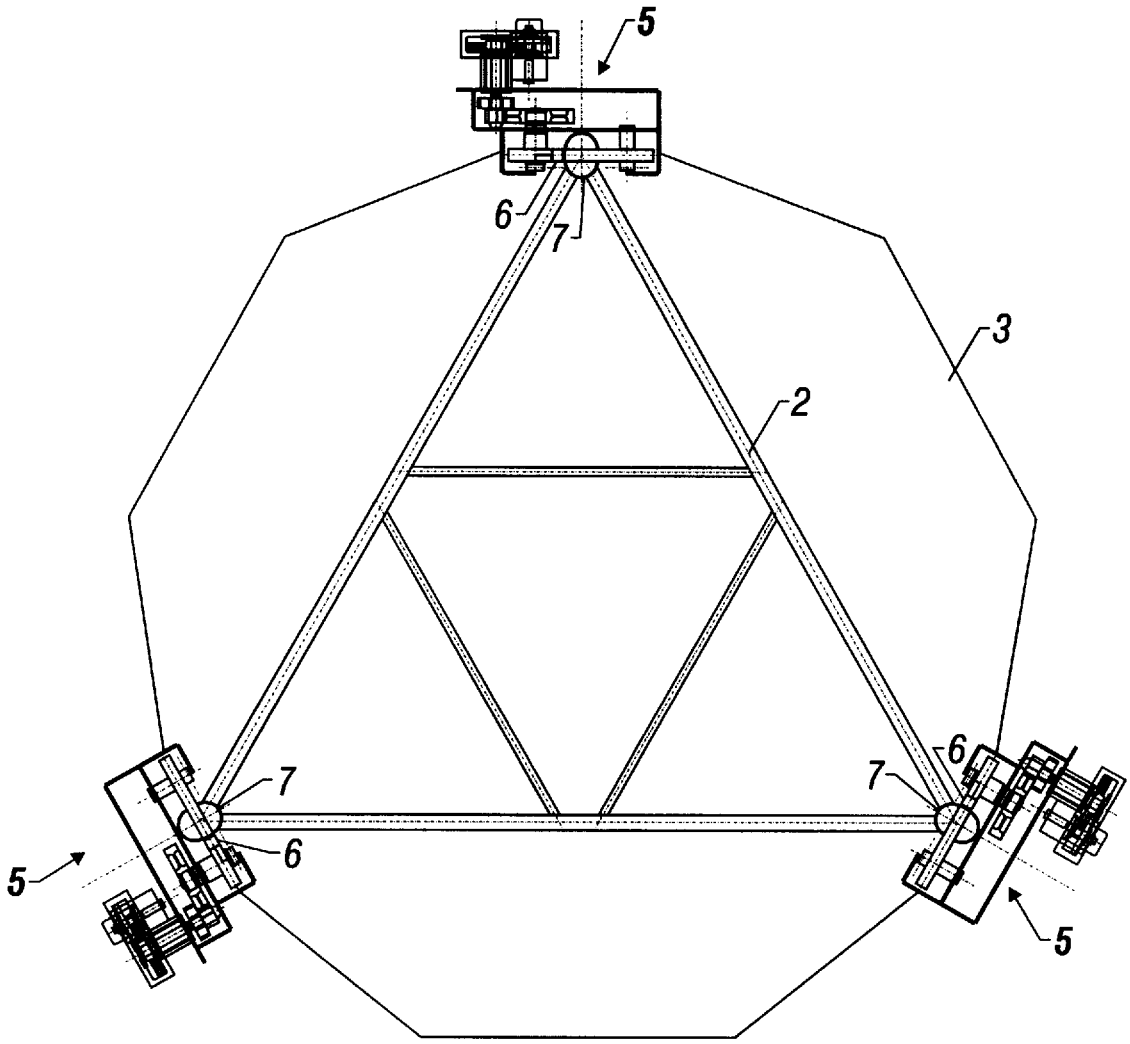
FIG. 3: is a plan view of one trussed leg of the jackup rig illustrating the location of the pinion gear drives for the apparatus.
Figure 15:
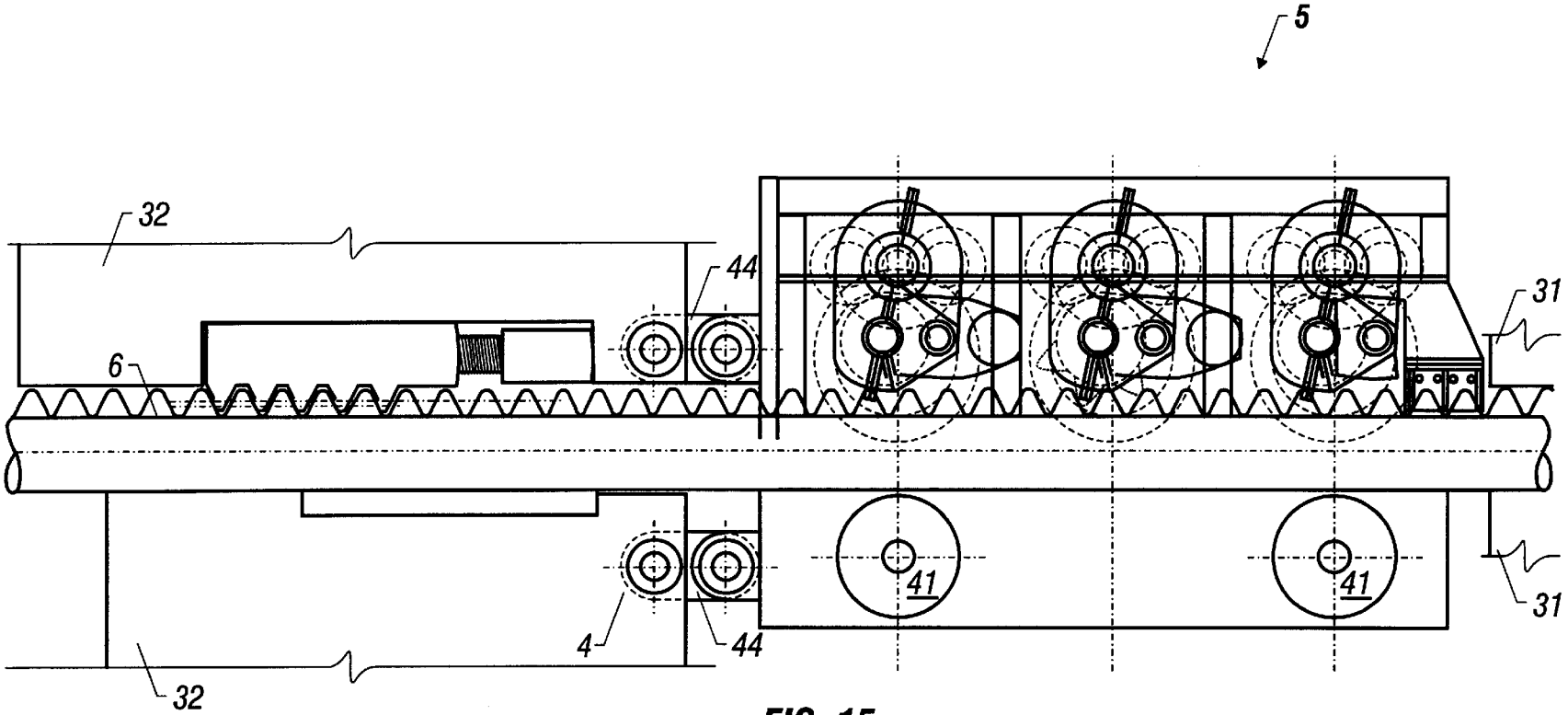
FIG. 15: is an elevation of the elevating gear racks and pinion drives and opposed rollers of the present invention and the improved hull to legs load transfer device of the present invention in the installed position.

FIGS. 1 and 2 illustrate, in elevation and plan respectively, one type of a self elevating mobile offshore platform 1. The platform is provided with trussed legs 2 which extend through openings 3 in the hull 4 of the jackup rig. Openings 3 are further provided with upper leg guides 31 and lower leg guides 32 as illustrated in FIG. 15. Each leg 2 is provided with a mechanism or mechanisms 5 for "jacking" or for moving the leg vertically with respect to the hull of the platform. These mechanisms 5 are commonly pinion gear drives mounted to the hull working in combination with one or more gear racks 6 fixed to each leg 2. FIG. 3 illustrates in plan an arrangement of one leg 2 provided with one gear rack 6 and a pinion gear drive 5 at each corner or chord 7 of the trussed leg. The gear racks 6 are fixed to or formed as part of the leg chords 7.

Figure 4:
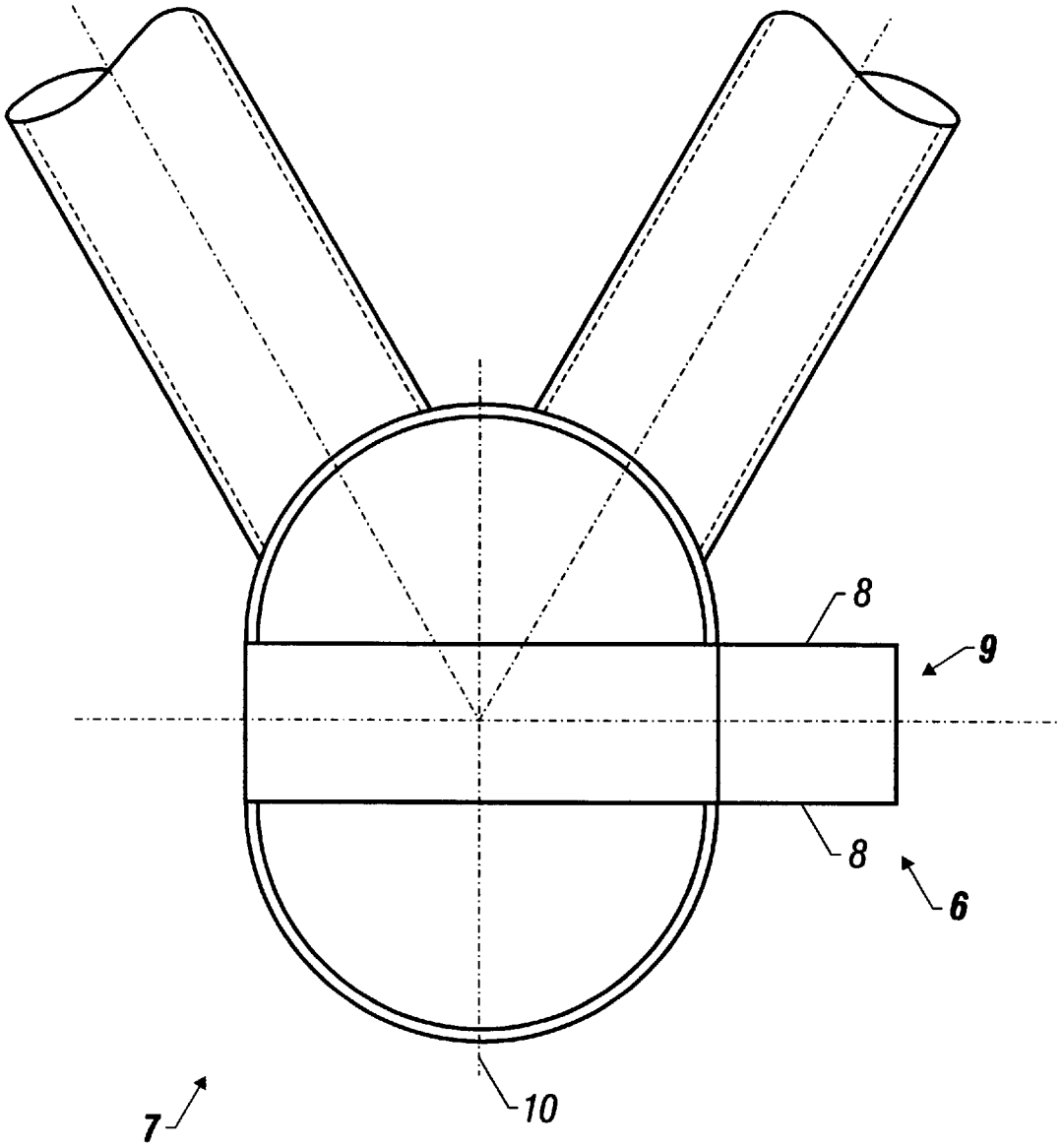
FIG. 4: is a cross sectional plan view of one corner or node of one leg of a jackup rig illustrating the location of the gear rack.

FIG. 4 is a cross sectional plan view of a corner or chord 7 which illustrates the location of the gear rack 6 which is arranged so that the vertical flat faces 8 on the sides of the gear rack teeth 9 will be normal to the axes 10 extending radially out from the centerlines of the legs 2.

Figure 7:
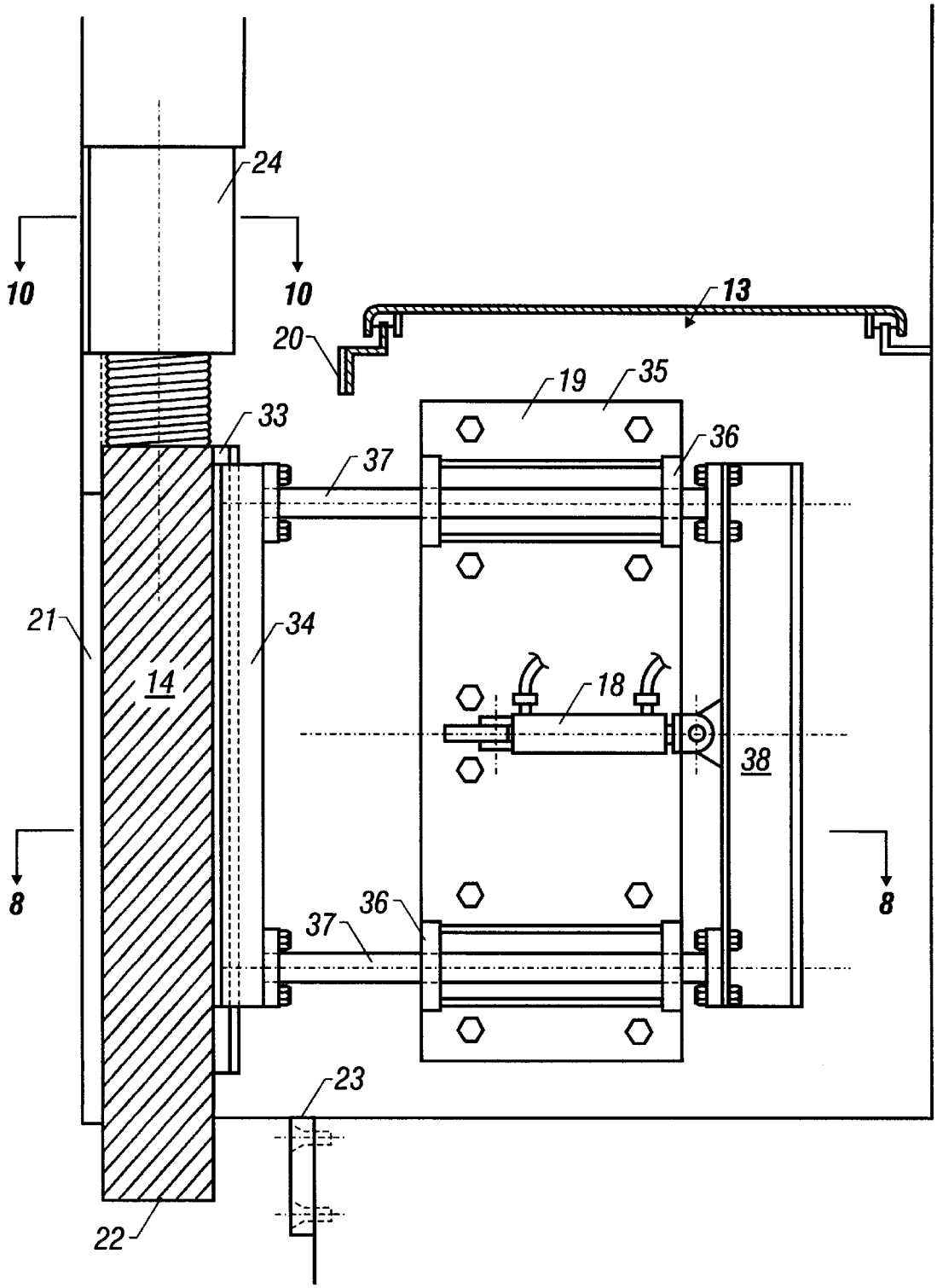
FIG. 7: is a cross sectional elevation of the improved hull to legs load transfer device of the present invention in the installed position.
Figure 8:
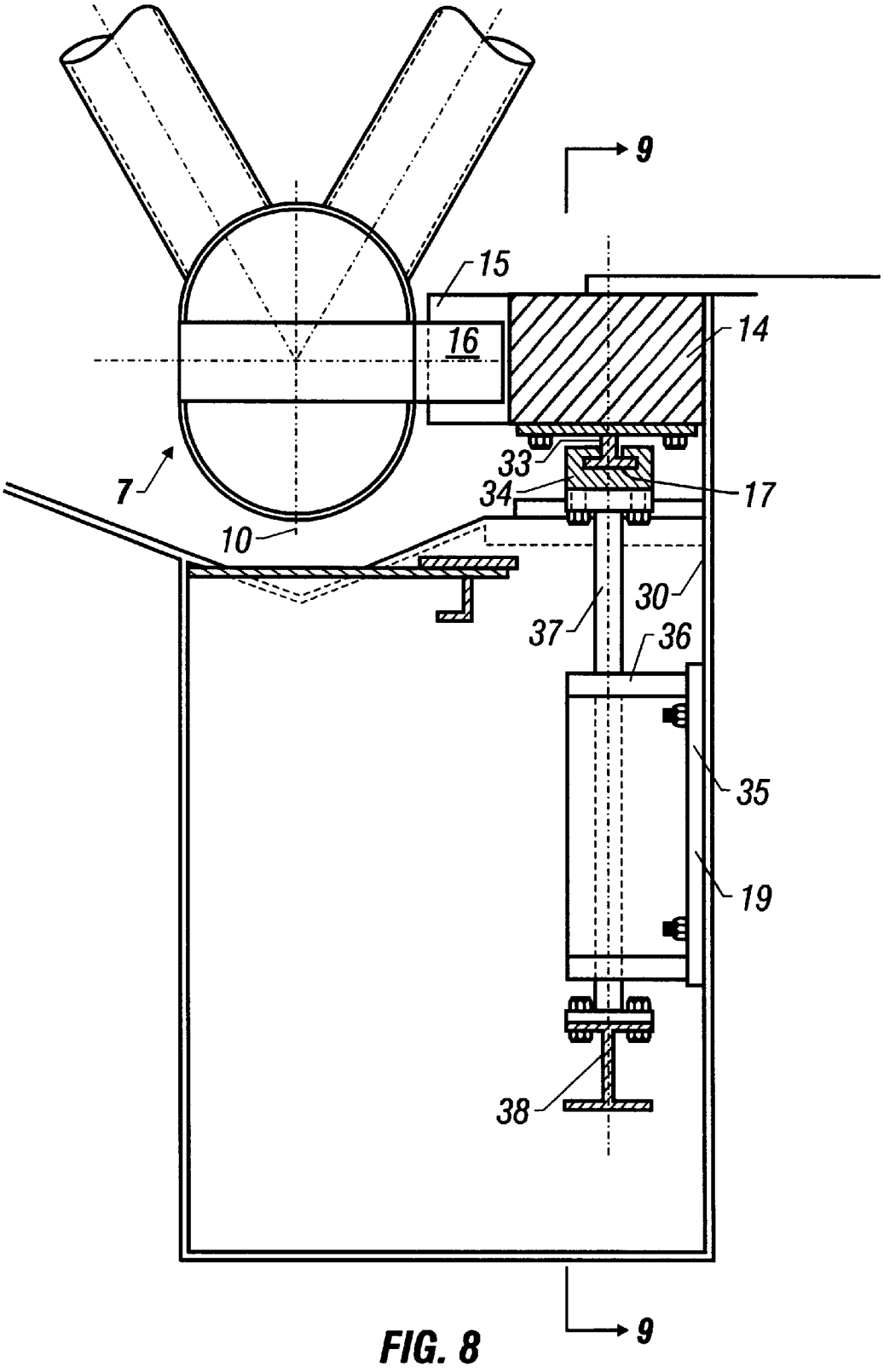
FIG. 8: is a cross sectional plan of the improved hull to legs load transfer device of the present invention in the installed position.
Figure 9:
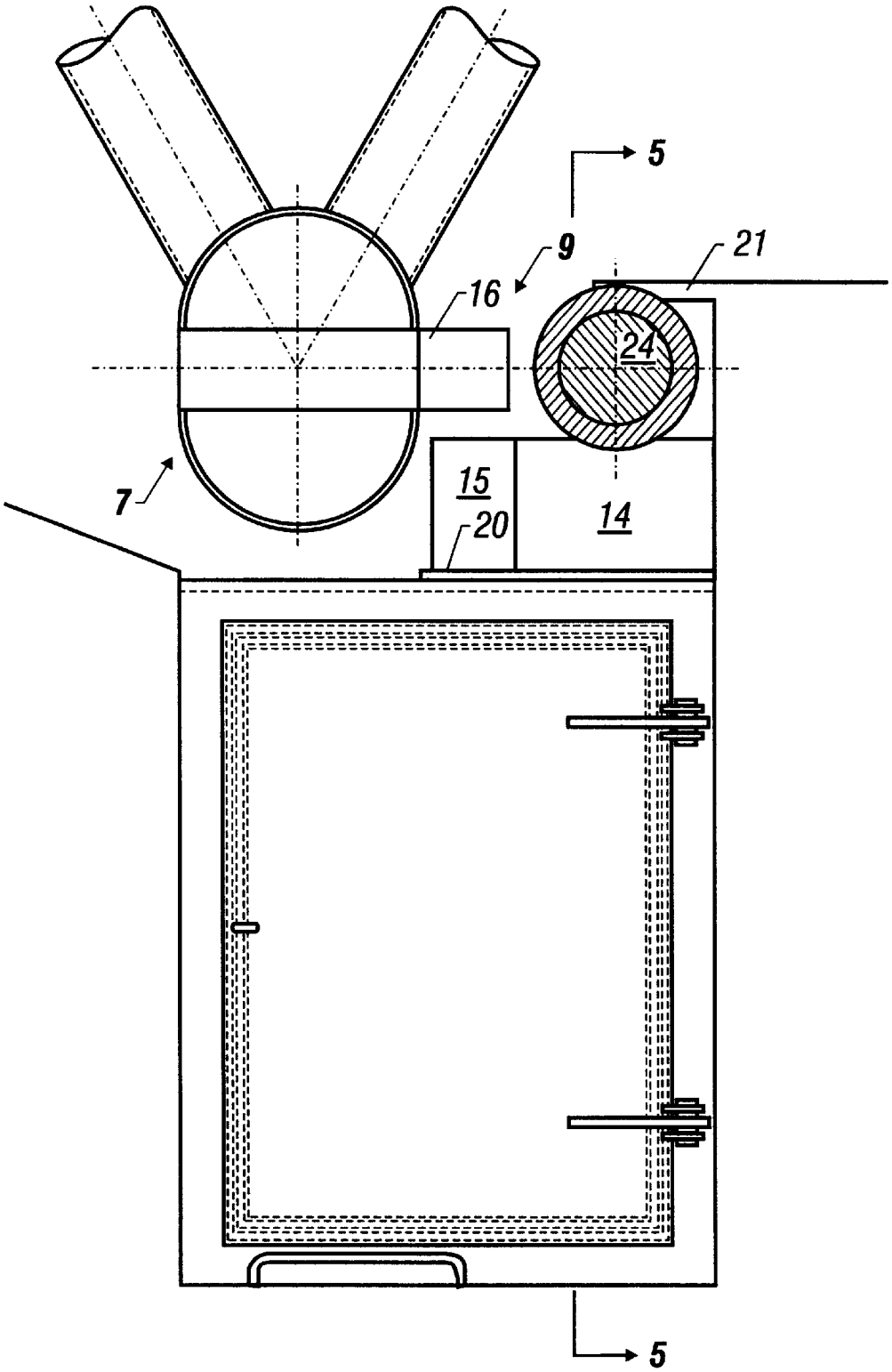
FIG. 9: is a second cross sectional plan view of the improved hull to legs load transfer device of the present invention in a retracted position.
Figure 10:
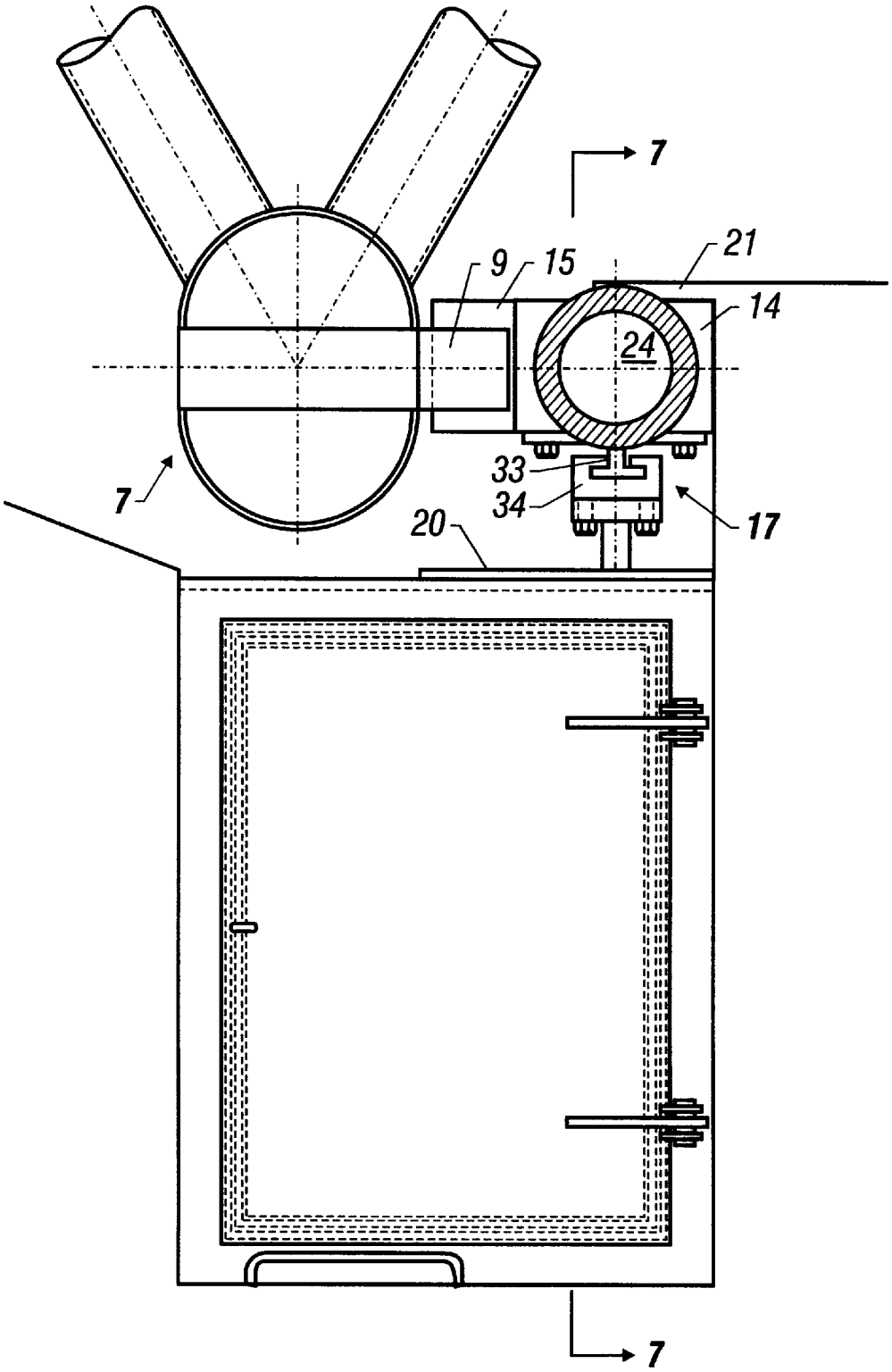
FIG. 10: is a second cross sectional plan view of the improved hull to legs load transfer device of the present invention in the installed position.

FIGS. 5, 6, 7, 8, 9, and 10 are various cross sectional view of the improved hull to legs load transfer device 13 of the present invention in both a retracted position (FIGS. 5,6,9) and in an extended or installed position (FIGS. 7,8,10). The load transfer device or rack locking device 13 incorporates one or more blocks 14 each of which is approximately rectangular in shape and each of which is provided with one or more protruding lugs 15 extending from one face of each rectangular block. The lugs 15 are shaped to permit engagement with the upper faces 16 of the gear rack teeth 9 to permit the transfer of forces between the gear racks on the leg chords and the hull.

As shown in FIGS. 5,6,7, and 8, an alignment guide 17 is provided and fixed to one face of the rectangular block at right angles to the face with lugs 15. As shown in the figures, in the primary embodiment illustrated the alignment guide 17 comprises a T shaped vertical tongue 33 formed as part of or affixed to the face of the rectangular block 14 facing away from the jack up rig. The T shaped tongue 3 3 is slidably mounted in a conforming C shaped channel groove 34.

Figure 5:
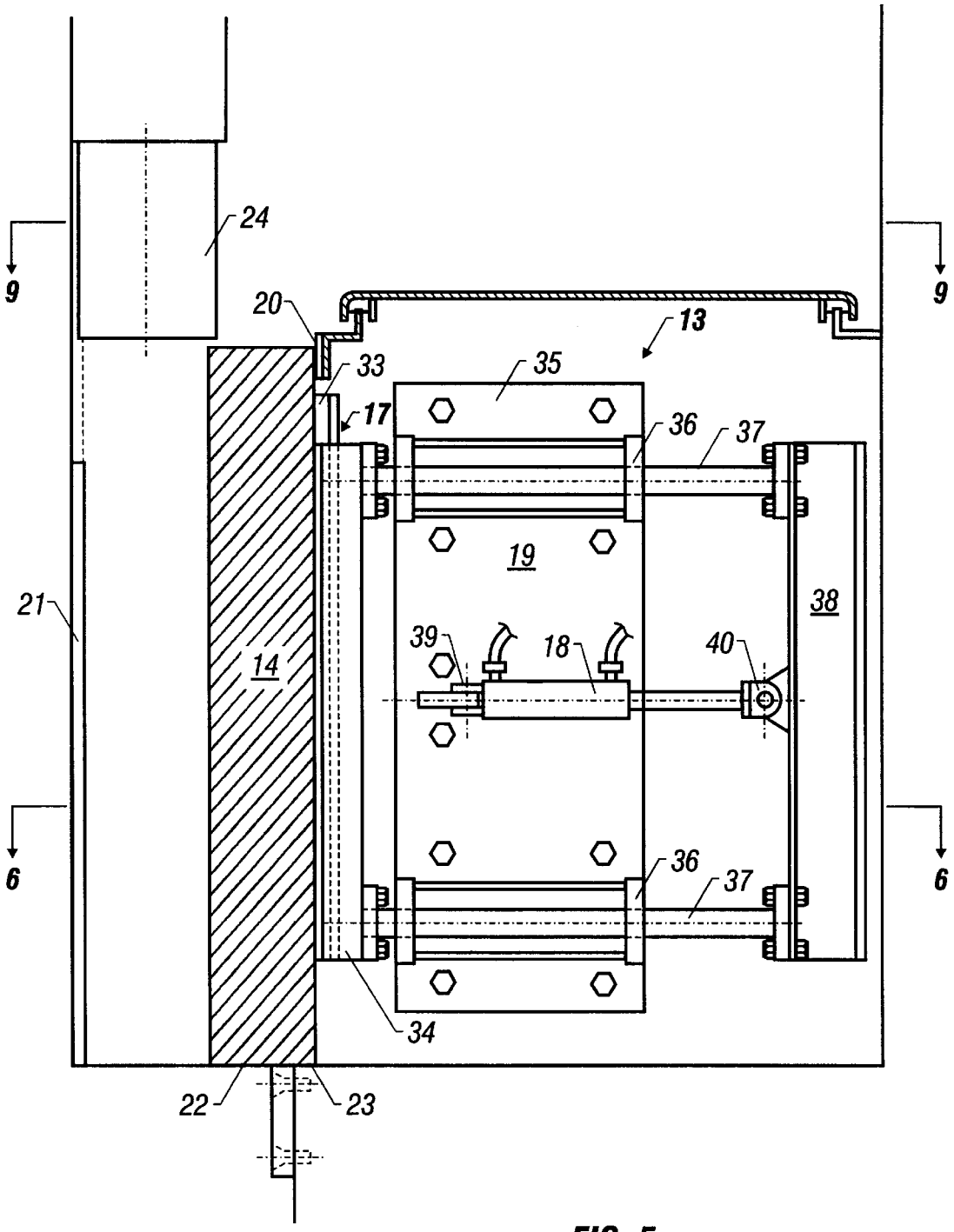
FIG. 5: is a cross sectional elevation of the improved hull to legs load transfer device of the present invention in a retracted position.
Figure 6:
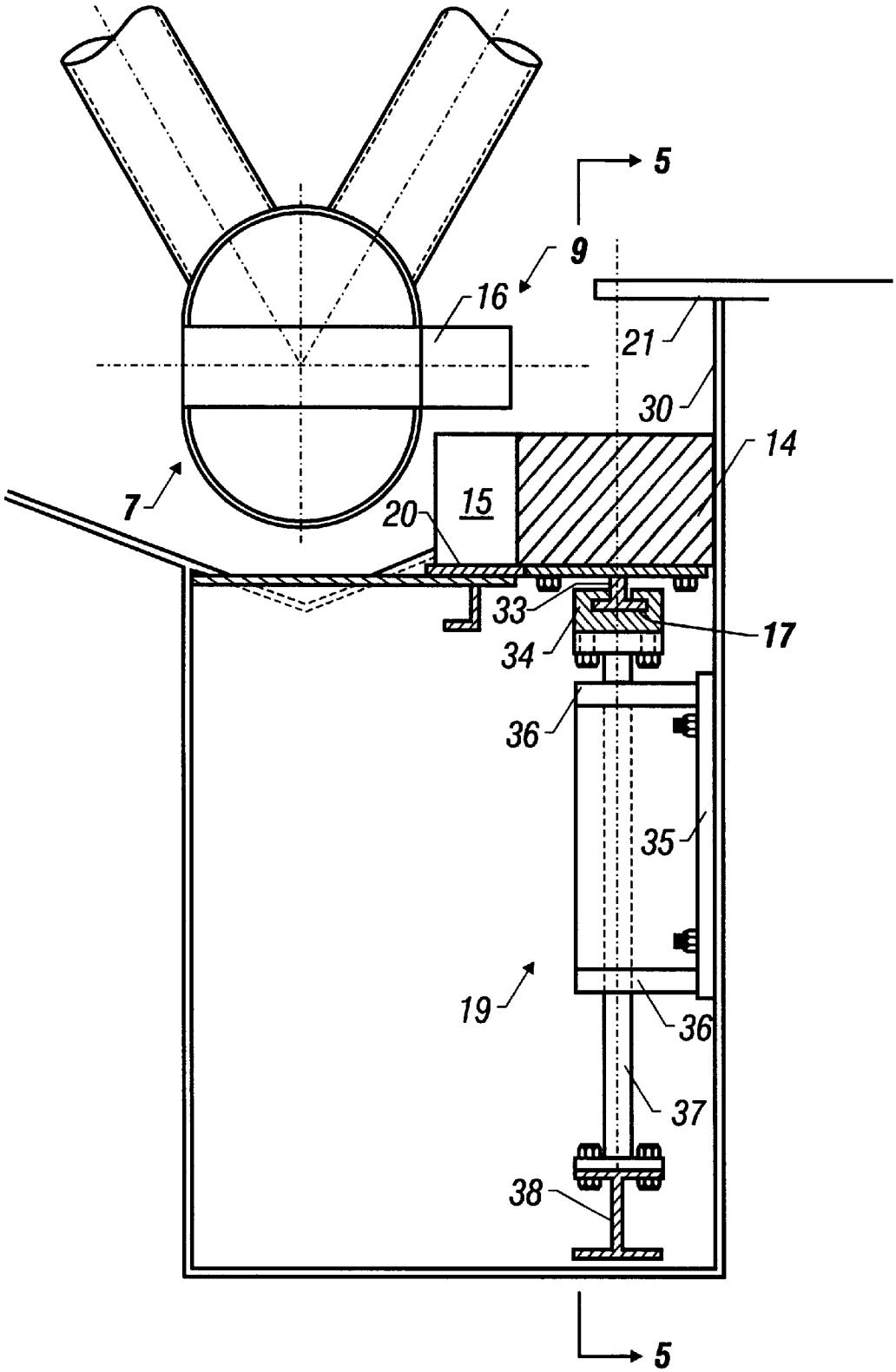
FIG. 6: is a cross sectional plan view of the improved hull to legs load transfer device of the present invention in a retracted position.

As shown in FIGS. 5 and 7, a hydraulic cylinder 18 or other equivalent powered apparatus such as electric or mechanical apparatus is attached to the alignment guide 17 by a horizontal guide structure 19. The alignment guide 17 and horizontal guide 19 are oriented so that when the cylinder is cycled the rectangular block 14 will travel horizontally in a direction normal to the flat sides 8 of the gear teeth 9. Horizontal guide structure 19 is provided to maintain the rectangular block in the desired alignment while permitting movement normal to the flat faces 8 of the gear rack teeth. Horizontal guide structure 19 in the preferred embodiment illustrated, and best viewed in FIG. 6, comprises an attachment 35, a plate bolted to the hull as illustrated in the primary embodiment. Attachment 35 carries a pair of orienting horizontal pilot assemblies 36, which are aligned parallel to the horizontal cylinder and the desired horizontal direction of travel for the rectangular block 14. Two rods 37 are mounted within the pilot assemblies 36. One end of each rod 37 is fastened to alignment guide 17 at channel groove 34. The opposite end of each rod is attached to a strongback 38. The horizontal cylinder 18 is mounted at a first end to the attachment plate 35 or otherwise connected to the hull. The opposite end of the cylinder 18 is attached to the strongback at 40, so that as the cylinder is actuated the rods 37 move horizontally carrying the rectangular block in the desired direction. The alignment guide 17 permits the rectangular block 14 to move vertically with respect to the horizontal guide structure 19.

FIGS. 5, 6, 7, 8, 9, and 10 illustrate two stops 20 and 21 that control the extent of horizontal movement possible. The stops are positioned so that when the rectangular block is stopped by 21 and fully extended as in FIGS. 7, 8, and 10 the centerlines of the rectangular blocks 14, protruding lugs 15 and gear racks 6 and gear rack teeth 9 are approximately collinear. FIGS. 5 and 7 also illustrate a support shelf or horizontal surface 23 and FIGS. 6 and illustrate 8 vertical support surface 30. The bottom face 22 of the rectangular block 14 is supported on a horizontal surface or support shelf 23 when the cylinder 18 and block 14 combination is in the retracted position. The vertical support surface 30 supports the horizontal guide structure 19 which holds rectangular block 14 in the desired position while the cylinder 18 or other actuating means slides the blocks off of the support shelf into the engaged position. The vertical support surface also assists in the transfer of horizontal forces. Also in FIGS. 5, 7, 9 and 10 is shown an adjustable support column 24. This adjustable support can be alternatively a screw adjustment or powered by hydraulic, electric, or other equivalent means. In a preferred embodiment it is contemplated to use a spur gear powered by a hydraulic motor. The interrelations of the workings of these components will be described in more detail below.

Figure 11:
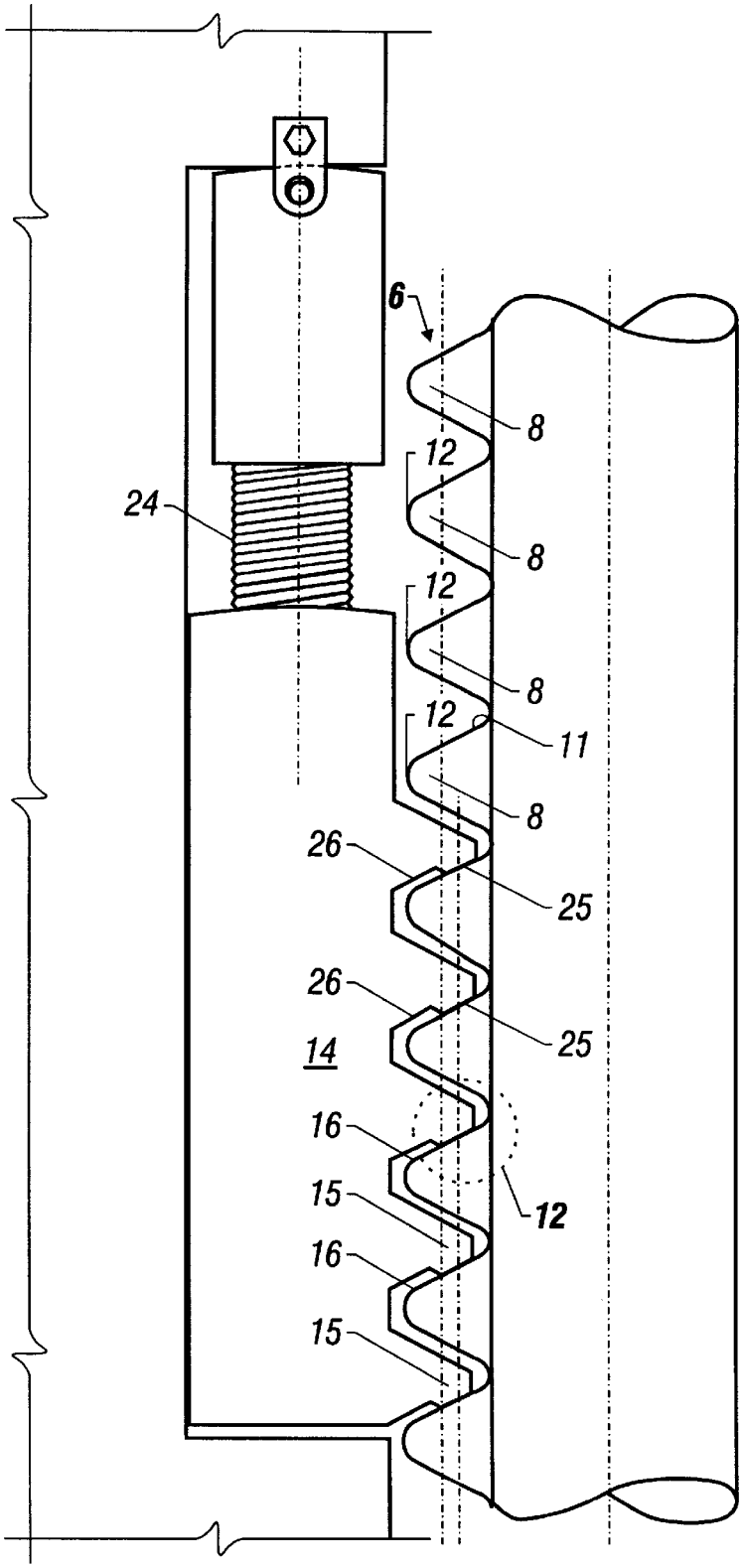
FIG. 11: is a detail of an elevation of the improved hull to legs load transfer device of the present invention in the installed position.
Figure 12:
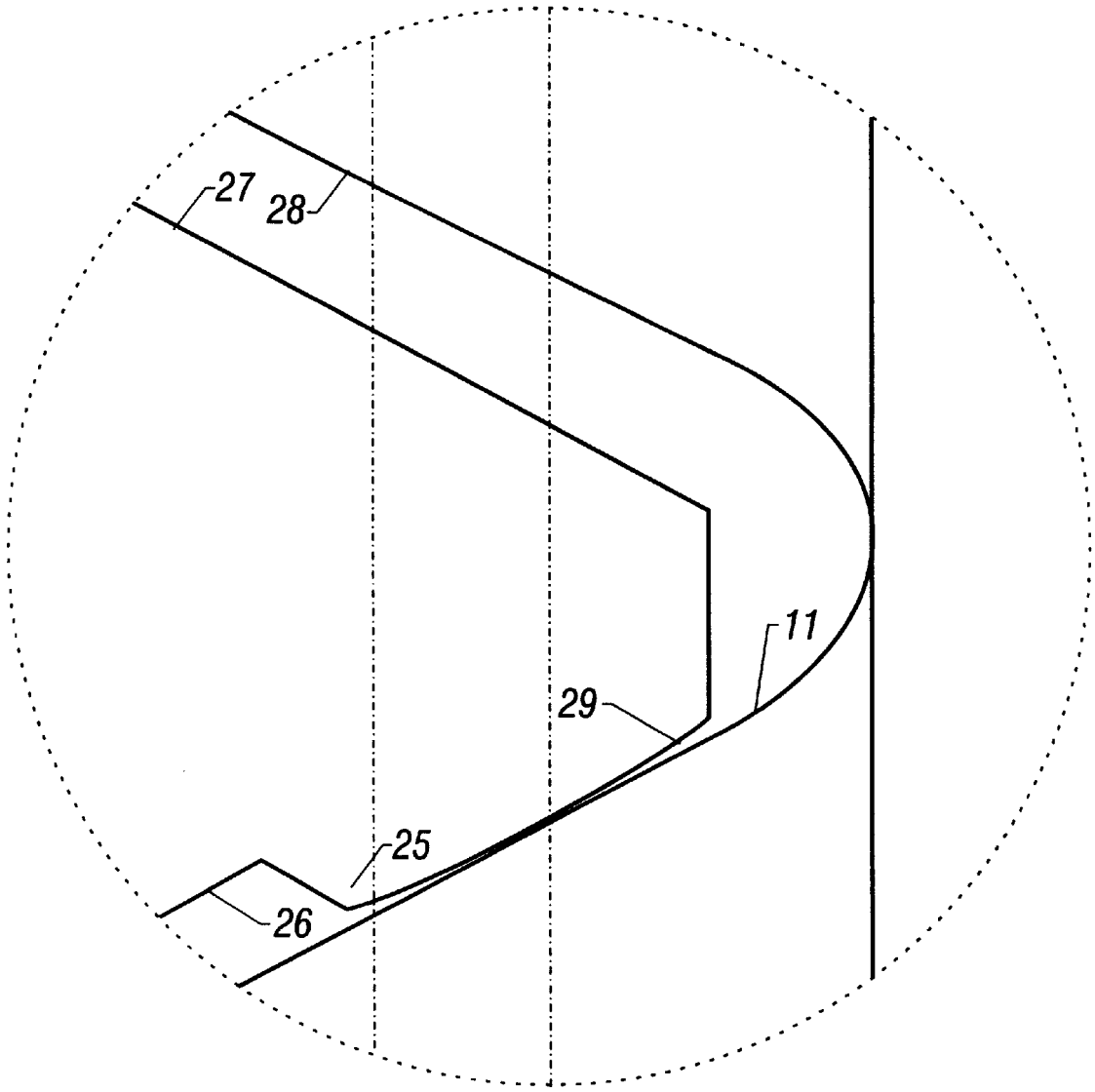
FIG. 12: is an expanded view of the components illustrated in FIG. 12.

FIGS. 11 and 12 illustrate the unique shape of the protruding lugs 15. Each lug 15 is shaped to include a protruding toe or contact surface 25 on the lower face 26 of the lug so that when interlocked with the upper face 16 of the teeth on the gear rack 6 the load will be carried by the root of the tooth 11 rather than the tip 12 to reduce shear stresses in the gear rack teeth 9. The lugs 15 are sized smaller than the openings in the gear rack defined by the gear rack teeth so that there will be no contact between the upper surface 27 of the lug 15 and the lower face 28 of the gear teeth 9 when the contact surfaces 25 of the lugs are bearing on the upper surface 16 of the gear teeth. As in FIG. 12 an optimum shape for the lugs 15 would also include a curved profile 29 for reasons set out before.

In the preferred embodiment comtemplated, the invention provides one gear rack 6 per leg chord 7, arranged such that the vertical flat faces 8 on the sides of the gear rack teeth 9 will be normal to axes 10 that extend radially out from the centerlines of the legs 2. This is shown in FIGS. 4, 8, and 14. The preferred embodiment mounts rollers 41, in the elevating gear unit housings 42. The rollers 41 are positioned with their perimeters tangent to the opposite sides of the leg chords from the gear racks. See FIGS. 13, 14, and 15. This orientation enables the rollers 41 to counteract the horizontal components of the forces that the jack pinions 43 apply to the gear racks 6. This preferred embodiment thus provides elevating gear unit support housings 42 that support elevating gear units 5 on one side of the leg chord 7 and horizontal force counteracting rollers 41 on the opposite sides of the leg chords.

Figure 13:
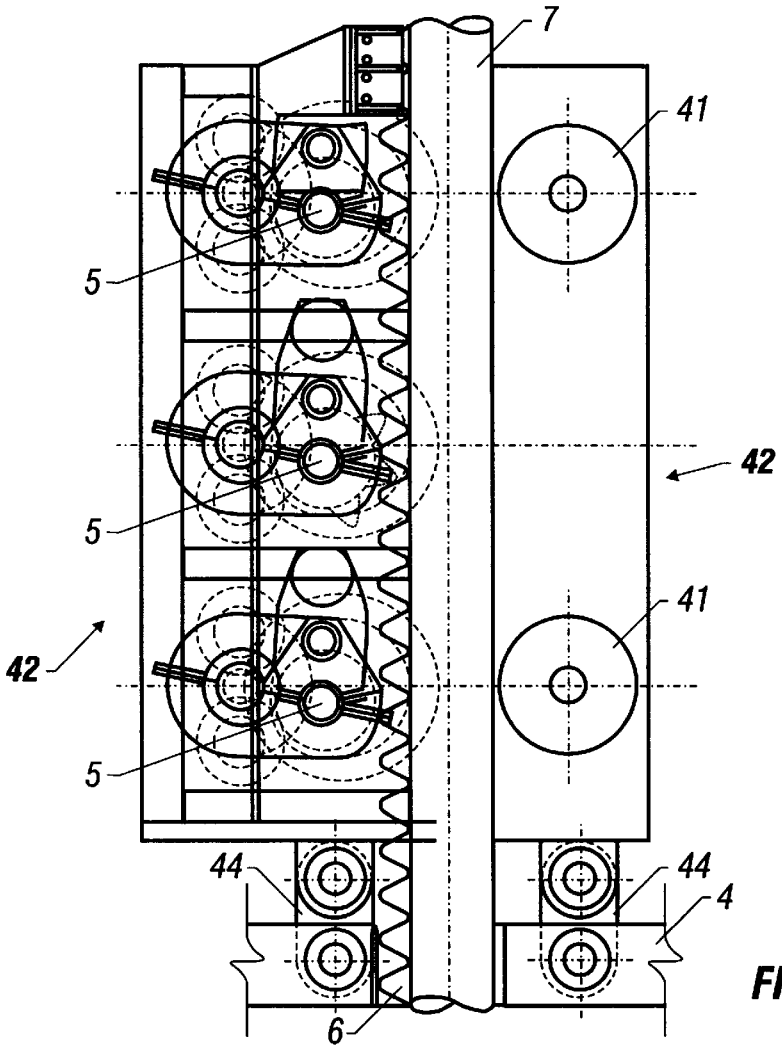
FIG. 13: is an elevation of the elevating gear racks and pinion drives and opposed rollers of the present invention.
Figure 14:
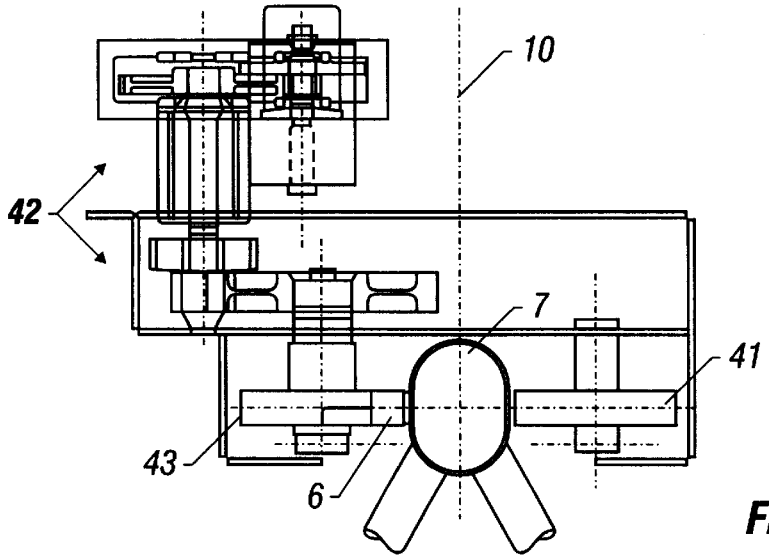
FIG. 14: is a plan of the elevating gear racks and pinion drives and opposed rollers of the present invention.

The invention in its preferred embodiment, as in FIGS. 13 and 15, also uses pinned link connections 44 between the elevating gear unit support housings 42 and the hull 4 to transfer vertical loads and provide stiffness for vertical load transfer between the legs 2 and the hull 4, but to permit torsional movement of the legs about their vertical centerlines within the constraints of the leg guides 31, 32 of the hull, the legs 2 and the hull 4.

FIG. 15 illustrates that the preferred embodiment of the invention positions lower leg guides 32 vertically, on the opposite sides of the leg chords 7 from the gear rack teeth 9. In this orientation the forces applied to the gear rack teeth 6 by the lugs 15, on the blocks 14, and the counteracting horizontal forces applied to the leg chords 7 by the lower leg guides 32, are resolved into vertical reactions collinear with the vertical axes of the leg chords.

DESCRIPTION OF THE USE OF THE INVENTION

When elevating out of the water, the platform is moving and the leg is sitting at the bottom of the ocean. When the proper elevation is reached, the hydraulic cylinders 19 are energized to partially engage the devices and to move the rectangular blocks 14 up against the vertical flat surfaces 8 of the gear racks 6. Jacking is continued while blocks 14 are pressing against the vertical flat surfaces 8. When the lugs 15 protruding from the faces of the blocks 14 are in vertical alignment with the spaces in the rack teeth, the blocks 14 can move further horizontally and the lugs 15 go into the fully engaged position as illustrated in FIGS. 7, 8, 10, 11, and 12. Generally one leg and three rectangular blocks 14 at a time will align, because the legs are most likely to be not in the same vertical alignment from one leg to the other because they are independent legs and they have different amounts of penetration in the sea. After the blocks 14 at one leg are aligned and the lugs 15 fit into the gear rack 6, jacking is continued and the blocks 14 slide off of the horizontal support surfaces 23, then slide vertically in the alignment guide 17 while resting on the top faces 16 of the gear teeth. As the rig continues to be jacked at some point another leg will align and another three blocks will be inserted, and the process continues as each leg is aligned. When all legs are aligned and the blocks are engaged, jacking is discontinued. Next each adjustable column 24 is adjusted or energized, to go down and bear tightly against the top of the blocks 14. At this point the device is set up to take load between the leg and the platform through bearing on the rack teeth to the rectangular blocks that bear against the adjustable column vertically and the hull horizontally. The adjustable column is mounted to or bears vertically against the structure of the hull.

After the rectangular blocks at each leg are fully engaged and locked by full adjustment of each adjustable column, the next step is to energize the jacking system to back drive the jacks so that the jacks are bearing against the underside of the rack teeth. Up to this stage the jacking system was climbing on the leg so that the pinion gears were bearing on the top surfaces of the rack teeth. When the jacking system is energized to go in the opposite direction, it will spin the pinions 43 to bear up against the underside of the gear rack teeth 6. The jacks are loaded up to a certain amount of pre-set torque, then the jacking down is discontinued and the brakes are energized to lock the pinion gears 43. Once locked, the components of the invention, in combination a locking device, provide for the lugs 15 bearing on the top side of the rack teeth 6 and the pinions 43 are loaded by back driving into bearing on the bottoms of the rack teeth 6. The described combination of jacks and the locking device of the present invention is prepared to take coupling vertical forces to resist storm induced moment between the hull 4 and the legs 2. The locking device takes the weight of the platform plus any load induced by the storm. The jacks 5 will take the load induced by the storm less the weight of the platform 1. The forces induced by the storm can be more than the forces induced by weight of the platform so the platform may try to lift off of some of the locking devices but it can't because the jack takes the load in the other direction. After the storm has been weathered and when the crew has discontinued or finished drilling and is ready to move to the next location, the first step will be to energize the jacks to jack the platform up just a slight amount and stop jacking. The adjustable columns are unloaded by this operation allowing them to be fully retracted. At that point the locking devices are loose and with no load on the locking devices, they can be retracted completely. The platform can be jacked down and as the platform comes down, the locking devices, or more specifically the hydraulic cylinders, are energized to retract and as the rig is jacked down the rectangular blocks 14 slide vertically in the alignment guides 17 until at some position reach the point where the bottom of the rectangular blocks 22 are aligned with the support shelves 23 and the blocks 14 can retract.

It should be apparent that many changes may be made in the various parts of the invention without departing from the spirit and scope of the invention and the invention and the detailed embodiments are not to be considered limiting but have been shown by illustration only.

What is claimed is:

1. An improved jackup platform elevating system, and an improved hull-to-legs load transfer device for an offshore jackup platform which utilizes at least one gear rack mounted to a leg of said jackup platform with teeth extending in a first direction, and at least one locking lug mounted for straight line movement for insertion from a second direction transverse to said first direction between said teeth of said gear rack, and further comprises rollers, mounted in elevating gear unit housings, and positioned with the perimeters of said rollers tangent to the opposite sides of the chords from the gear racks.

2. The invention of claim 1 further comprising at least one elevating gear unit on one side of each leg chord of said jack up rig and horizontal force counteracting rollers on the opposite side of each of said leg chords from said elevation gear units.

3. The invention of claim 2 further comprising pinned link connections between the elevating gear unit support housings and the hull to transfer vertical loads and provide stiffness for vertical load transfer between the legs and the hull, but to permit torsional movement of the legs about their vertical centerlines within the constraints of the leg guides of the hull.

4. The invention claim 3 wherein lower leg guides are vertically positioned, on the opposite sides of the leg chords from the gear rack teeth, such that the forces applied to the gear rack teeth by the lugs, on said blocks, and the counteracting horizontal forces applied to the leg chords by the lower leg guides, are resolved into vertical reactions collinear with the vertical axes of the leg chords.

5. The invention of claim 4 further comprising at least one powered gear train at each leg for adjusting said platform vertically relative to said legs.

6. The invention of claim 5 wherein said gear train is electrically powered.

7. The invention of claim 3 further comprising at least one powered gear train at each leg for adjusting said platform vertically relative to said legs.

8. The invention of claim 7 wherein said gear train is electrically powered.

9. The invention of claim 2 wherein lower leg guides are vertically positioned, on the opposite sides of the leg chords from the gear rack teeth, such that the forces applied to the gear rack teeth by the lugs, on said blocks, and the counteracting horizontal forces applied to the leg chords by the lower leg guides, are resolved into vertical reactions collinear with the vertical axes of the leg chords.

10. The invention of claim 2 further comprising at least one powered gear train at each leg for adjusting said platform vertically relative to said legs.

11. The invention of claim 10 wherein said gear train is electrically powered.

12. The invention of claim 1 further comprising at least one powered gear train at each leg for adjusting said platform vertically relative to said legs.

13. The invention of claim 12 wherein said gear train is electrically powered.

14. An improved jackup platform elevating system, and an improved hull-to-legs load transfer device for an offshore jackup platform which utilizes at least one gear rack mounted to a leg of said jackup platform, and at least one locking lug for insertion between teeth of said gear rack, and further comprises rollers, mounted in elevating gear unit housings, and positioned with the perimeters of said rollers tangent to the opposite sides of the chords from the gear racks; and pinned link connections between the elevating gear unit support housings and the hull to transfer vertical loads and provide stiffness for vertical load transfer between the legs and the hull, but to permit torsional movement of the legs about their vertical centerlines within the constraints of the leg guides of the hull.

15. The invention of claim 14 further comprising at least one powered gear train at each leg for adjusting said platform vertically relative to said legs.

16. The invention of claim 15 wherein said gear train is electrically powered.

17. An improved jackup platform elevating system, and an improved hull-to-legs load transfer device for an offshore jackup platform which utilizes at least one gear rack mounted to a leg of said jackup platform, and at least one locking lug for insertion between teeth of said gear rack, and further comprises rollers, mounted in elevating gear unit housings, and positioned with the perimeters of said rollers tangent to the opposite sides of the chords from the gear racks; and lower leg guides vertically positioned, on the opposite sides of the leg chords from the gear rack teeth, such that the forces applied to the gear rack teeth by the lugs, on blocks upon which said lugs are mounted, and the counteracting horizontal forces applied to the leg chords by the lower leg guides, are resolved into vertical reactions collinear with the vertical axes of the leg chords.

18. The invention of claim 17 further comprising at least one powered gear train at each leg for adjusting said platform vertically relative to said legs.

19. The invention of claim wherein said gear train is electrically powered.

* * * * *